US010570738B2

(12) United States Patent
Braxmaier et al.

(10) Patent No.: US 10,570,738 B2
(45) Date of Patent: Feb. 25, 2020

(54) PUMP DEVICE WITH DEFORMABLE PUMP RING

(71) Applicant: EBM-PAPST ST. GEORGEN GMBH & CO. KG, St. Georgen (DE)

(72) Inventors: Markus Braxmaier, Schwenningen (DE); Hassan Ghodsi-Khameneh, Offenburg (DE); Daniel Hauer, Ortenberg (DE); Juergen Herr, St. Georgen (DE); Marc Jeuck, Buehl/Badan (DE); Gerhard Kuhnert, Villingen (DE); Wolfgang Laufer, Aichhaden (DE); Mario Staiger, Schramberg-Tennenbronn (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 147 days.

(21) Appl. No.: 15/557,111

(22) PCT Filed: Mar. 31, 2016

(86) PCT No.: PCT/EP2016/057155

§ 371 (c)(1),
(2) Date: Sep. 10, 2017

(87) PCT Pub. No.: WO2016/173798

PCT Pub. Date: Nov. 3, 2016

(65) Prior Publication Data

US 2018/0051564 A1 Feb. 22, 2018

(30) Foreign Application Priority Data

Apr. 29, 2015 (DE) ..... 10 2015 106 610

(51) Int. Cl.
*F04B 43/14* (2006.01)
*F04B 43/00* (2006.01)
(Continued)

(52) U.S. Cl.
CPC ..... *F01C 5/02* (2013.01); *F04B 43/10* (2013.01); *F01N 2610/1406* (2013.01); *F01N 2610/1433* (2013.01); *F04C 2240/30* (2013.01)

(58) Field of Classification Search
CPC ..... F01C 5/02; F04C 5/00; F04C 15/0015; F04B 43/1238; F04B 43/0036; F04B 43/0054; F04B 43/14; F04B 43/0072
(Continued)

(56) References Cited

U.S. PATENT DOCUMENTS 3,408,947 A * 11/1968 McMillan ..... F04B 43/14 418/45
3,583,838 A * 6/1971 Stauber ..... F04B 43/14 418/45
(Continued)

FOREIGN PATENT DOCUMENTS

DE 10 2011 015 110 B3 1/2012
DE 10 2013 104 245 A1 10/2014
(Continued)

*Primary Examiner* — Deming Wan
(74) *Attorney, Agent, or Firm* — Dickinson Wright PLLC

(57) ABSTRACT

The invention relates to a pump device for pumping a liquid, comprising a hydraulics housing (12, 212), in which a pump ring (14, 214), a pump ring support (16, 216) and an eccentric (18), which can be driven by a shaft (20), are accommodated. The hydraulics housing (12, 212) has an annular portion (22, 222) and a first and a second lateral section (24, 26, 224), the two lateral sections (24, 26,224) being arranged opposite each other. The pump ring (14, 214) is mounted between the two lateral sections (24, 26, 224) of the hydraulics housing (12, 212) at least in some portions. On a side facing away from the pump ring support (16, 216), two first projections (28, 228), which run in the axial direction of the shaft (20), are each in contact with one of the two lateral sections (24, 26, 224).

15 Claims, 5 Drawing Sheets

(51) Int. Cl.

| | |
|---|---|
| ***F01C 5/02*** | (2006.01) |
| ***F04C 5/00*** | (2006.01) |
| ***F04C 15/00*** | (2006.01) |
| ***F04B 43/10*** | (2006.01) |

(58) Field of Classification Search
USPC ..... 418/153, 125, 127–129, 152, 156
See application file for complete search history.

(56) References Cited

U.S. PATENT DOCUMENTS

| | | | | |
|---|---|---|---|---|
| 4,332,534 | A * | 6/1982 | Becker | F04B 43/14 418/153 |
| 9,453,507 | B2 | 9/2016 | Ghodsi-Kameneh et al. | |
| 9,752,484 | B2 | 9/2017 | Brueck et al. | |
| 2017/0144692 | A1 | 5/2017 | Russell et al. | |

FOREIGN PATENT DOCUMENTS

| | | | | |
|---|---|---|---|---|
| GB | 583578 | A * | 12/1946 | F04B 43/14 |
| WO | WO 2012/126544 | A1 | 9/2012 | |
| WO | WO 2015/140207 | A1 | 9/2015 | |

* cited by examiner

PUMP DEVICE WITH DEFORMABLE PUMP RING

The invention relates to a pump device for pumping a fluid.

A pump device or pump is understood here to mean a machine which serves to transport fluids. These also include fluid-solid mixtures, pastes and fluids with a slight gas content. During operation of the pump device, the work of the drive is converted into the kinetic energy of the transported fluid.

The illustrated pump device is also referred to as an orbital pump, rotary diaphragm pump or peristaltic pump.

The pump device can be used to transport a fluid from a reservoir, for example a tank, into a desired environment, for example into an exhaust system of an internal combustion engine.

Known from the publication DE 10 2013 104 245 A1 is a pump device which is configured as an orbital pump which has a pump housing with at least one inlet and at least one outlet, wherein an eccentric is arranged on the pump housing so as to be rotatable relative to the pump housing. An electric drive is provided in order to move the eccentric. Arranged between the eccentric and the pump housing is a deformable diaphragm which, together with the pump housing, delimits a delivery path from the at least one inlet to the at least one outlet and forms at least one seal of the delivery path. The at least one seal is displaceable, through a movement of the eccentric, in order to deliver the fluid along the delivery path.

The publication WO 2012/126544 A1 describes a metering system for metering a liquid with a pump device which is equipped with an eccentric drive which can be driven by an electric motor. The pump device, which has two delivery directions, has a pump ring and a stationary ring which is arranged relative to the pump ring and to the eccentric drive in such a way that a pump chamber is formed between the stationary ring and the pump ring which changes shape upon rotation of the electric motor in order to deliver a liquid to be metered through the pump chamber. The functional principle of an orbital pump is described in this publication.

Against this background, a pump device with the features of claim 1 is presented. Embodiments thereof are disclosed in the dependent claims and in the description.

A pump device for pumping a fluid is presented herein, comprising a hydraulics housing within which a deformable pump ring, a pump ring support and an eccentric are accommodated. Said eccentric is driven by a shaft, which can in turn typically be driven by a controllable drive, for example an electric motor.

The hydraulics housing comprises an annular portion and a first and second lateral section, wherein the two lateral sections are arranged opposite one another, and wherein the pump ring is arranged, at least in certain portions, between the two lateral sections of the hydraulics housing.

In addition, in the pump device presented, two first projections extending in the axial direction of the shaft are provided on a side facing away from the pump ring support which are in each case in contact with one of the two lateral sections of the hydraulics housing. This means that a first one of the two first projections is in contact with the first lateral section and a second one of the two first projections is in contact with the second lateral section.

The pump ring can be formed of an elastomeric material, which guarantees a lasting deformability. Elastomeric materials are available in different degrees of hardness, so that a functionally optimal structure of the pump device can be realized. In one embodiment, the Shore hardness of the pump ring lies between 55 and 70 Shore.

The shaft defines an axial and a radial direction of the pump device.

In one embodiment, the first projections are circumferential in form, i.e. they extend along the outer contour of the pump ring.

In one embodiment, cavities are defined by the annular portion and the two lateral sections of the hydraulics housing into which cavities the first projections are pressed. That is to say a spatial region into which the first projections are pressed is in each case defined by the annular portion and the first lateral section or by the annular portion and the second lateral section.

It can also be the case that, when the first projections are pressed in, in each case at least one free space remains in the cavities, i.e. a spatial region within which no part of the pump ring is arranged.

In a further embodiment, at least one of the lateral sections has a lip which projects into one of the cavities, said lip limiting a movement of a region of an associated first projection in a radial direction. This limitation prevents the pump ring from being deflected outwards locally when the pump ring is compressed and thus leads to a higher pressure on the axially opposite side and thus an increased leak tightness.

The lip can thereby be arranged such that in a first lip region this makes contact with one of the first projections and in a second lip region this does not make contact with one of the first projections. It thus serves to limit the radial extension of the projection in the lip region.

It can also be the case that at least parts of the first lip region are arranged further inwards, radially, than the second lip region. The lip thus limits the movement of the pump ring radially outwards.

In a further embodiment, at least one first sealing lip is provided on the annular portion of the hydraulics housing in the region of at least one of the first projections. This means that at least one first sealing lip is provided on the annular portion of the hydraulics housing in the region of the first of the two first projections and/or at least one first sealing lip is provided in the region of the second of the two projections. This first sealing lip is, or these first sealing lips are, for example, molded on the hydraulics housing, in order not to create an additional gap for a leak.

At least one second sealing lip can also be provided on at least one of the two lateral sections of the hydraulics housing in the region of at least one of the first projections. This means that at least one second sealing lip is provided on at least one of the two lateral sections of the hydraulics housing in the region of the first of the two first projections and/or at least one second sealing lip is provided in the region of the second of the two projections. This second sealing lip is, or these second sealing lips are, for example, molded on the hydraulics housing.

The at least one first sealing lip and the at least one second sealing lip can be arranged opposite one another.

In one embodiment, at least two first sealing lips can be provided on the annular portion of the hydraulics housing in the region of at least one of the first projections which are associated with one of the two lateral sections. The double sealing lips offer an additional barrier for the fluid and provide a better seal than one sealing lip.

The at least two first sealing lips can thereby comprise an outer first sealing lip and an inner first sealing lip, wherein the outer first sealing lip is arranged further outwards, radially, than the inner first sealing lip, and wherein the outer first sealing lip extends further in an axial direction towards the associated lateral section than the inner first sealing lip. The outer sealing lip thus generates a greater pressure on the pump ring. Investigations have shown that, during a movement of the pump, fluid which penetrates into the region between the inner and outer first sealing lip flows back into the pump chamber due to the higher pressure of the outer first sealing lip. This has led to a significant improvement in the leak tightness of the pump device.

In yet a further embodiment, the annular portion of the hydraulics housing has a first collar by means of which the first lateral section of the hydraulics housing is held in a radial direction of the shaft.

In yet a further embodiment, the annular portion of the hydraulics housing has a second collar by means of which the second lateral section of the hydraulics housing is held in a radial direction of the shaft.

In each case this enables the lateral sections to be securely held and simplifies assembly.

The pump device presented has, at least in some of the embodiments, advantages in comparison with known pump devices. For example, a high leak tightness is achieved, which makes possible a rapid and high pressure build-up. This at least reduces, or even wholly eliminates, the risk of both an internal leak, in which the fluid flows back within the pump chamber contrary to the delivery direction, as well as an external leak, in which the fluid leaks out of the pump chamber into other regions of the pump device.

In one embodiment, the pump ring comprises a base from which two first projections extend on a side facing away from the pump ring support, wherein the first projections in each case comprise a first section and a second section, wherein the first section connects the second section with the base, wherein the first section extends to a greater extent in a radial direction than in an axial direction and the second section extends to a greater extent in an axial direction than in a radial direction, wherein a pocket is formed in at least one of the two lateral sections in which an axially outer end of the second section is accommodated.

In one embodiment, a pocket is formed in at least one of the two lateral sections in which an axially outer end of an associated first projection is accommodated. The pocket thus prevents a deflection of the axially outer end and thus a reduction of the pressure during pressing. Figuratively speaking, the axially outer end is fixed like a spring in the groove formed by the pocket.

Further advantages and variants of the invention are disclosed in the description and the enclosed drawing.

It should be understood that the aforementioned features and those which will be explained in the following can be used not only in the combination stated in each case but also in other combinations or on their own without departing from the scope of the present invention.

The invention is represented schematically in the drawing with reference to various embodiments and will be described schematically and in detail with reference to the drawing, wherein.

Figure 1:
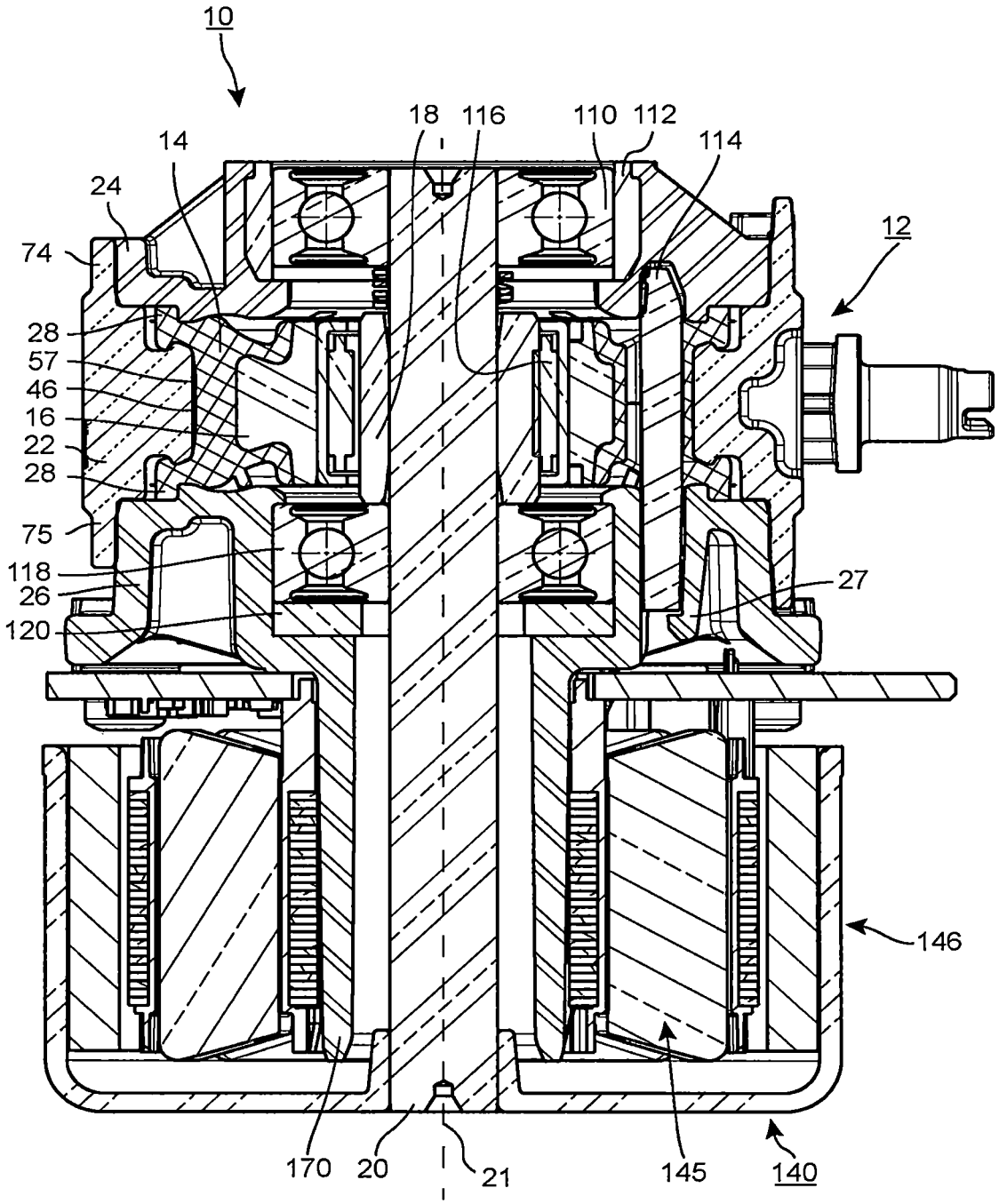
FIG. 1 shows a sectional view of an embodiment of the described pump device.

FIG. 1 shows a sectional view of an embodiment of the described pump device, which is identified as a whole with the reference number 10 and is implemented as an orbital pump. The illustration shows a hydraulics housing 12, a pump ring 14, a pump ring support 16, an eccentric 18, a shaft 20, a drive 140, a first bearing 110, a second bearing 118, a bushing or socket 112, which can also be described as a ring 112, a clamping element 114, which can also be described as a separating chamber pin, an eccentric bearing 116, and a sealing ring 120, which can also be described as a gasket 120.

In this embodiment, the first bearing 110 is installed as a floating bearing, and the second bearing 118 as a fixed bearing. This provides a good mounting.

A needle bearing can be used as the eccentric bearing 116. This has a short extent in a radial direction. Other bearing types, for example roller bearings, are also possible. The eccentric bearing 116 makes possible a low-friction transmission of forces between the rotating eccentric 18 and the rotationally-fixed pump ring 14 or pump ring support 16.

The hydraulics housing 12 comprises an annular portion 22 and a first lateral section 24, which can also be described as a pump cover, and a second lateral section 26, which can also be described as a motor flange or drive flange. The two lateral sections 24, 26 are arranged opposite one another. The pump ring 14 thereby lies, at least in portions thereof, between the two lateral sections 24, 26 of the hydraulics housing 12. The annular portion 22 has a first collar 74 and a second collar 75.

The drive 140 has a stator arrangement 145 and a rotor arrangement 146. The drive 140 is partially attached to a tubular region 170 of the second lateral section 26.

The pump housing 12 has a snap-locking element 27, which is designed to snap into engagement, upon introduction of the clamping element 114 into the pump housing 12 and to secure the clamping element 114 axially. The introduction of the clamping element 114 can take place before the installation of the drive 140.

The pump ring 14 is deformable and can be made of an elastomeric material or another deformable material.

Figure 2:
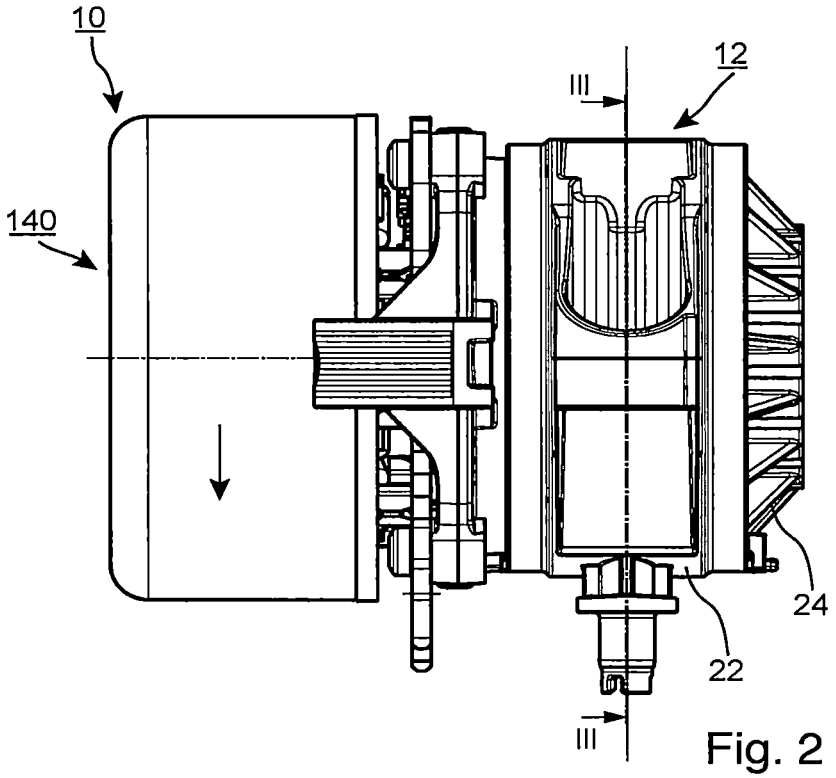
FIG. 2 shows a side view of the pump device from FIG. 1.

FIG. 2 shows a side view of the pump device 10 shown in FIG. 1.

Figure 3:
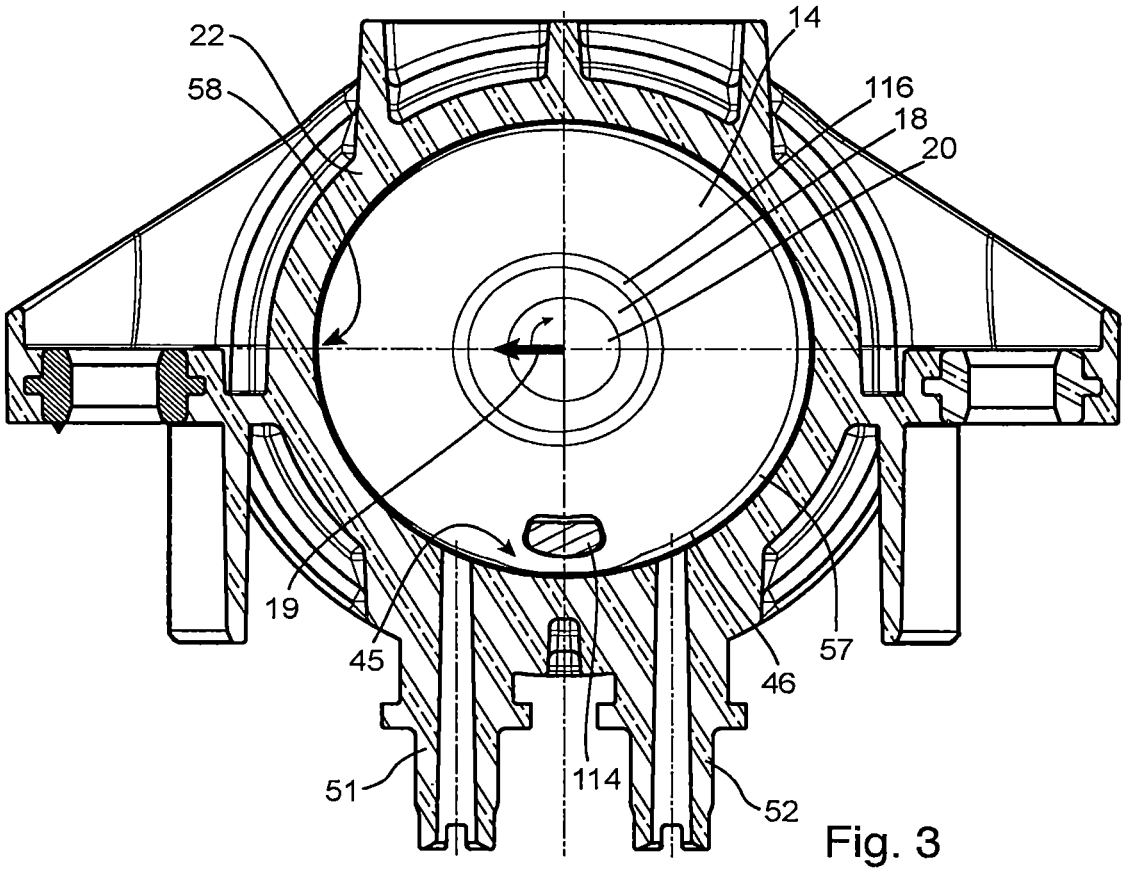
FIG. 3 shows a sectional view of the pump device from FIG. 1.

FIG. 3 shows a cross section through the pump device 10, viewed along the section line III-III shown in FIG. 2. A first connection 51 and a second connection 52 are provided, and these connections 51, 52 are in fluid communication with a pump chamber 57 which is formed between the annular portion 22 of the hydraulics housing and a contact surface 46 of the pump ring and in the illustration shown in FIG. 3 extends in an annular manner from the first connection 51 in a clockwise direction up to the second connection 52. In the section which extends from the first connection 51 in an anticlockwise direction up to the second connection 52, the pump chamber 57 is deactivated through the clamping element 114 in that the clamping element 114 presses the contact surface 46 of the pump ring 14 statically against the annular portion 22 of the hydraulics housing 12, thus preventing or at least greatly reducing a fluid flow through this section. The region in which the clamping element 114 presses the contact surface 46 of the pump ring 14 against the annular portion 22 is also referred to in the following as the "clamping element region" 45.

The illustration depicts the interior of the hydraulics housing 12 schematically and in an exaggerated manner, in terms of the deformation of the pump ring 14, in order to explain the principle.

The functional principle of the orbital pump is described in the following with reference to FIG. 1 and FIG. 3.

The eccentric 18 sits on the shaft 20 and is driven by this. The drive 140, typically a motor or electric motor, serves in turn to drive the shaft 20. According to one embodiment, a controllable drive 140 is provided as a drive 140.

The shaft 20 is thereby rotated around its longitudinal axis 21, which defines an axial direction of the pump device 10. The eccentric 18 is thus also moved around the longitudinal axis of the shaft 20 in a rotational movement. This movement of the eccentric 18 is transmitted via the bearing 116 and via the pump ring support 16 to the pump ring 14. The pump ring support 16 and the pump ring 14 are rotationally fixed relative to the hydraulics housing 12, but depending on the rotational position of the eccentric 18 they are moved locally closer to or further away from the annular portion 22. In FIG. 3, the eccentric 18 points in a direction indicated with an arrow 19, pointing to nine o'clock in the example illustrated, i.e. the region of the eccentric 18 with the greatest radial extent or dimension points in the direction of the arrow 19. This causes the pump ring 14 to be moved in this direction 19 and pressed against the annular portion 22 in the region 58. As a result, the pump channel 57 is narrowed or completely blocked in the region 58.

If the eccentric now rotates in a clockwise direction, the point 58 at which the pump ring 14 is pressed against the annular portion 22 also travels along in a clockwise direction, and as a result the fluid in the pump chamber 57 is pumped or transported in a clockwise direction from the first connection 51 to the second connection 52. A hydraulic short circuit in which the fluid passes from the second connection 52 in a clockwise direction to the first connection 51 is prevented through the clamping element 114 or another interruption of the pump chamber 57 in this region.

The pump device 10 also functions in the reverse direction, in that the direction of rotation of the eccentric 18 is reversed.

Figure 4:
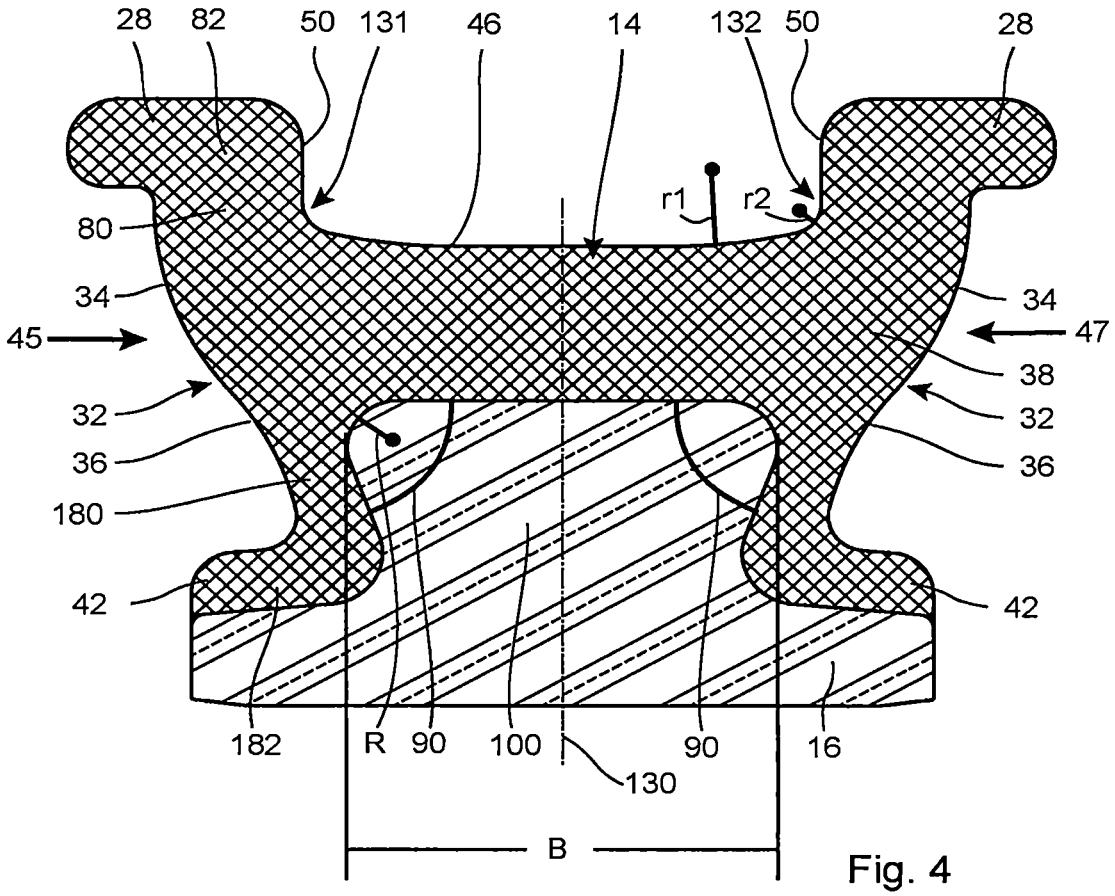
FIG. 4 shows a sectional view of an embodiment of the pump ring.

FIG. 4 shows a sectional view of the pump ring 14 from FIG. 1. The profile of the pump ring 14 and of the pump ring support 16 can be seen, and the sectional view corresponds to a longitudinal section through the pump device 10.

The pump ring 14 comprises a first axial side 45 and a second axial side 47. On the first axial side 45 and the second axial side 47, the profile of the pump ring 14 in each case follows an S-formed curve 32 with a convex section 34 and a concave section 36, wherein the convex section 34 lies further outwards in a radial direction of the shaft in comparison with the concave section 36.

The pump ring 14 comprises a base 38 from which two first projections 28 extend on a side facing away from the pump ring support 16 and two second projections 42 extend on a side facing the pump ring support 16. The contact surface 46 is thereby limited by side walls 50 of the first projections 28.

The first and second projections 28, 42, in each case, comprise a first section 80, 180 and a second section 82, 182, w herein the first section 80, 180 in each case connects the second section 82, 182 with the base 38. It can be seen that the first section 80, 180 extends to a greater extent in a radial direction than in an axial direction and the second section 82, 182 extends to a greater extent in an axial direction than in a radial direction. In other words, the first section 80, 180 has, at least in certain regions, a lesser axial extent than the second section 82, 182.

The two second projections 42, in each case, enclose an angle 90 of around 80° with the base 38 of the pump ring 14 in the region of the transition to the base 38. As a result, a secure connection between the pump ring 14 and the pump ring support 16 is guaranteed. A tongue 100 formed on the pump ring support 16 thereby projects into the region between the two second sections 42 of the pump ring 14.

In the embodiment shown, the convex section 34 of the curve 32 lies, in an axial direction, between one of the lateral sections 24, 26 of the hydraulics housing and the base 38 of the pump ring 14.

Further, the concave section 36 of the curve 32 lies, in an axial direction, between one of the lateral sections 24, 26 of the hydraulics housing and the tongue 100 of the pump ring support 16, wherein the tongue 100 lies, in an axial direction, at least partly between the two second projections 42.

The concave section 36 of the curve 32 lies, in a radial direction, at least partly on the level of the first section 180 of the second projection 42.

The pump ring 14 is connected with the pump ring support 16, for example by means of adhesive bonding. The contact surface 46 of the pump ring 14 is provided on the side of the pump ring 14 facing away from the pump ring support 16. This contact surface 46 is, in the pump chamber 57, pressed against the annular portion 22 or pulled away therefrom depending on the rotational position and rotational movement of the eccentric 18.

It can be seen that the contour of the contact surface 46 has a curvature that changes, at least in portions, wherein, beginning from a center 130 of the contact surface 46, the curvature increases towards the two ends. This means that the radius of the curvature is reduced towards the ends. By way of example, a first radius r1 and a second radius r2 are indicated in the drawing, and it can be seen that the first radius r1 is greater than the second radius r2, which is closer to the end 132.

In the embodiment shown, the path of the contour is symmetrical in relation to this center 130. However, an asymmetrical structure can also be chosen.

The coverage of the pump ring support 14 laterally to the pump ring support 16, i.e. in the region of the first section 180 of the second projection 42, amounts to around 1.0 mm. This means that the depth or the thickness of the pump ring 14 in this region is around 1.0 mm. However, other coverages or thicknesses can be chosen. A coverage of more than 0.9 mm has proved suitable.

The tongue 100 can be formed with a curvature in the region between the base 38 and the second projection 42 which, at least in portions, has a radius R.

A width of the pump ring support 16 is identified with B. The width of the pump ring support 16 is understood to mean the effective width of the region of the pump ring support 16 during compression of the pump ring 14. In the present exemplary embodiment, this is the region of the pump ring support 16 which lies against the base 38 of the pump ring 14, and the width of the pump ring support 16 corresponds to the width of the tongue 100.

Figure 5:
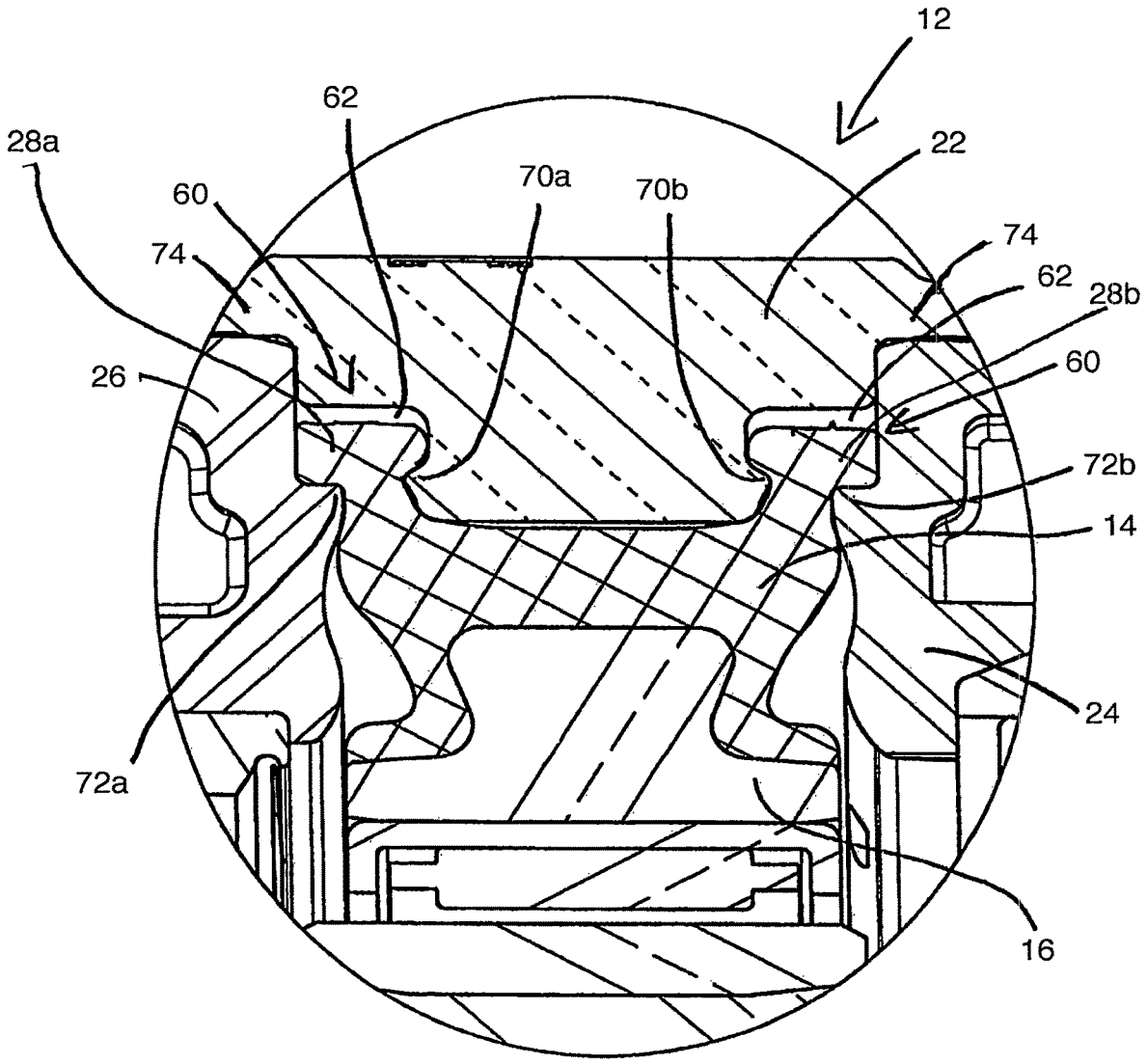
FIG. 5 shows a section from the pump device from FIG. 1.

A section from the pump device 10 of FIG. 1 is shown in FIG. 5. In particular, the illustration shows that the pump ring 14 has two first projections 28*a*, 28*b* which extend in an axial direction of the shaft on a side facing away from the pump ring [support] 16. The left-hand first projection 28*a* is thereby in contact with the second lateral section 26 and the right-hand lateral section 28*b* is in contact with the first lateral section 24.

The illustration also shows that cavities 60 are defined by the annular portion 22 and the two lateral sections 24, 26 of the hydraulics housing 12 into which cavities the first projections 28*a*, 28*b* are pressed. At least one free space 62 remains in the respective cavities 60 when the first projections 28*a*, 28*b* are pressed in. Referring to the first projection identified with the reference number 28*a* as a left-hand first projection 28*a* means that this is drawn in on the left-hand side in the illustration. The same applies to the right-hand first projection 28*b*.

It can be seen that, on the annular portion 22 of the hydraulics housing 12, a left-hand first sealing lip 70*a* is provided in the region of the left-hand first projection 28*a* and a right-hand first sealing lip 70*b* is provided in the region of the right-hand first projection 28*b*.

The illustration also shows that a left-hand second sealing lip 72*a* is provided on the second lateral section 26 in the region of the left-hand first projection 28*a* and a right-hand second sealing lip 72*b* is provided on the first lateral section 24 in the region of the right-hand first projection 28*b*. The left-hand first sealing lip 70*a* lies at least partially opposite the left-hand second sealing lip 72*a* in an axial direction. The right-hand first sealing lip 70*b* lies at least partially opposite the right-hand second sealing lip 72*b* in an axial direction.

Figure 6:
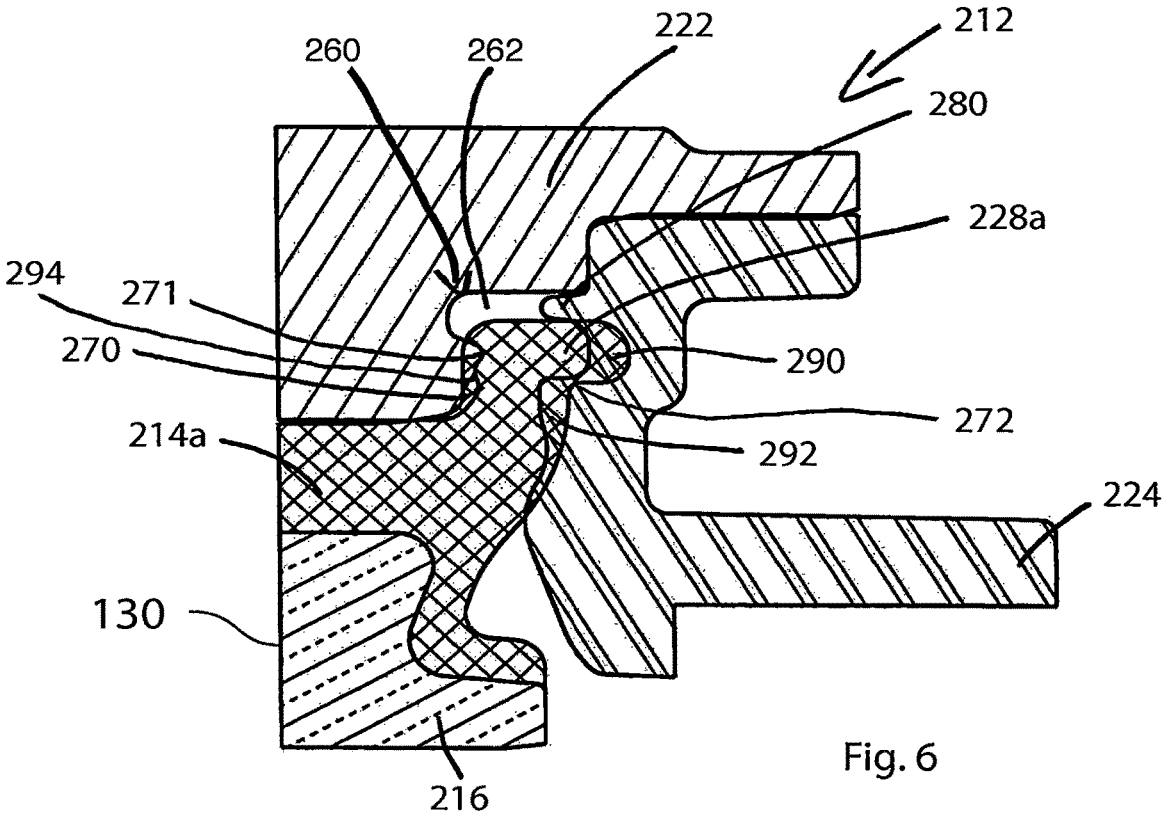
FIG. 6 shows a section from a hydraulics housing with uncompressed pump ring.

FIG. 6 shows a section from an embodiment of a hydraulics housing 212 in which a pump ring 214*a* and a pump ring support 216 are accommodated. The hydraulics housing 212 comprises an annular portion 222 and two lateral sections, of which only the first section 224 is shown in this illustration. In this representation, provided by way of illustration, the pump ring 214*a* is shown in an uncompressed state with an uncompressed first projection 228*a*.

Figure 7:
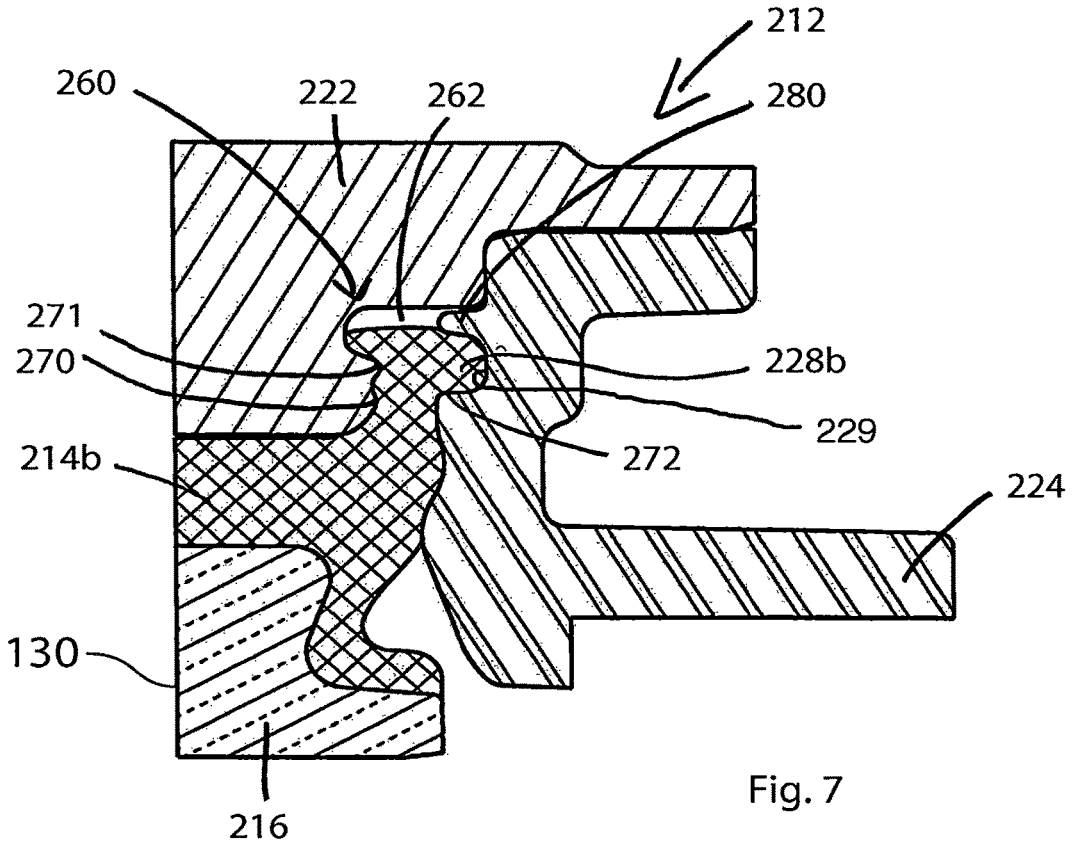
FIG. 7 shows the section from FIG. 6 with compressed pump ring.

The illustration shows a first overlap region 290, a second overlap region 292 and a third overlap region 294 which represent regions of the pump ring 214*a* which are displaced through compression, which leads to a deformation of the pump ring 214*a* (see FIG. 7).

The illustration also shows that a cavity 260 is defined by the annular portion 222 and the lateral section 224 of the hydraulics housing 212 into which the first projection 228*a*, shown here in an uncompressed state, is compressed.

It can be seen from the illustration that two first sealing lips 270, 271 are provided, in this case molded, on the annular portion 222 of the hydraulics housing 212 in the region of the first projection 228*a*.

The illustration also shows that a second sealing lip 272 is provided, in this case molded, on the lateral section 224 of the hydraulics housing 212 in the region of the first projection 228*a*.

In addition, a lip 280 can be seen which is arranged, in this case molded, on the lateral section 224 between the first projection 228*a* and the annular portion 222 and in the embodiment shown projects into the cavity 262. This lip 280 prevents a movement of the first projection 228*a* in a radial direction and thus fixes the first projection 228*a* in this direction.

FIG. 7 shows the section from FIG. 6 with the pump ring 214*b* in a compressed state. It can be seen that the overlap regions 290, 292 and 294 are displaced through deformation of the pump ring 214*b*, in particular in the region of the first projection 228*b*.

The embodiment shown in FIG. 6 and FIG. 7 with the sealing lips 270, 271, 272 and the lip 280 shown causes an increase in the pressure on the pump ring 214 and effectively reduces the risk of a leak.

It can be seen that a pocket 229 is provided in the lateral section 224. This is arranged between the lip 280 and the sealing lip 272. The axially outer end of the first projection 228*b*, i.e. the end of the first projection 228*b* facing axially away from the center 130 of the contact surface 46, engages in this pocket 229 and as a result prevents a deflection in a radial direction. This increases the pressure on the pump ring 14 during pressing and thus the leak tightness.

The second lateral section 226 can be structured accordingly on its inner side, that is to say also with the sealing lips 270, 271, 272, the lip 280 and/or the pocket 229.

Naturally, a wide range of variants and modifications are possible within the scope of the present invention.

For example, the first sealing lips 70*a*, 70*b*, 270, 271 and the second sealing lips 72*a*, 72*b*, 272 can also be configured in the form of additional insert parts.

The contact surface 46 of the pump ring 14 can also be described as a delivery chamber surface 46 of the pump ring 14.

The invention claimed is:

1. Pump device for pumping a liquid, comprising
a hydraulics housing (12, 212) within which a deformable pump ring (14, 214),
a pump ring support (16, 216) and
an eccentric (18) are accommodated, said eccentric (18) being driven by a shaft (20), said shaft defining an axial and a radial direction,
wherein
the hydraulics housing (12, 212) has
an annular portion (22, 222),
a first lateral section (24, 224), and
a second lateral section (26), the two lateral sections (24, 26, 224) being arranged opposite each other,
wherein the pump ring (14, 214) is, at least in some portions, mounted between said first and second lateral sections (24, 26, 224) of the hydraulics housing (12, 212) and has two first projections (28, 28*a*, 28*b*, 228) which extend in an axial direction of the shaft (20) on a side facing away from the pump ring support (16, 216) which are, in each case, in contact with one of the two lateral sections (24, 26, 224), and
wherein cavities (60 260) are defined by the annular portion (22,222) and the two lateral sections 24, 26, 224) of the hydraulics housing (12, 212) into which the cavities the first projections (28, 228) are pressed, and said hydraulics housing section (22, 24, 26) and said first projections (28, 228) are configured such that at least one free space (62, 262) remains in the cavities (60, 260) when the first projections (28, 228) are pressed in.

2. Pump device according to claim 1, wherein the pump ring (14, 214) is made of an elastomeric material.

3. Pump device according to claim 1, wherein at least one of the lateral sections (24, 26, 224) has a lip (280) which projects into one of the cavities (60, 260), said lip (280) limiting a movement, in a radial direction, of a region of the associated first projection (28, 228).

4. Pump device according to claim 1, wherein a lip (280) is arranged such that, in a first lip region, said lip makes contact with one of the first projections (28, 228) and, in a second lip region, said lip does not make contact with one of the first projections (28, 228).

5. Pump device according to claim 4, wherein at least parts of the first lip region are arranged further inwards, radially, than the second lip region.

6. Pump device according to claim 4, wherein at least one first sealing lip (70, 270, 271) is provided on the annular portion (22, 222) of the hydraulics housing (12, 212) adjacent at least one of the first projections (28, 228).

7. Pump device according to claim 6, wherein at least two first sealing lips (270, 271) are provided on the annular portion (22) of the hydraulics housing (12, 212) adjacent at least one of the first projections (228), said at least two first sealing lips (270, 271) being associated with one of the two lateral sections (24, 26, 224).

8. Pump device according to claim 7, wherein the at least two first sealing lips (270, 271) comprise an outer first sealing lip (271) and an inner first sealing lip (270), wherein the outer first sealing lip (271) is arranged further outwards, radially, than the inner first sealing lip (270), and wherein the outer first sealing lip (271) extends further in an axial direction towards an associated lateral section (24, 26, 224) than the inner first sealing lip (270) extends.

9. Pump device according to claim 8, wherein at least one second sealing lip (72, 272) is provided on at least one of the two lateral sections (24, 26, 224) of the hydraulics housing (12, 212) in the region of at least one of the first projections (28, 228).

10. Pump device according to claim 9, wherein at least one of the at least one second sealing lips (72, 272) is molded on one of the two lateral sections (24, 26, 224) of the hydraulics housing (12, 212).

11. Pump device according to claim 6, wherein at least one of the at least one first sealing lips (70, 270) is molded on the annular portion (22, 222) of the hydraulics housing (12, 212).

12. Pump device according to claim 6, with at least one first sealing lip (70, 270, 271), and with at least one second sealing lip (72,272), wherein a first sealing lip (70, 270, 271) and a second sealing lip (72, 272) are arranged at least partially opposite one another.

13. Pump device according to claim 1, wherein the annular portion (22, 222) of the hydraulics housing (12, 212) has a first collar (74) by which the first lateral section (24, 224) of the hydraulics housing (12, 212) is held in a radial direction of the shaft (20).

14. Pump device according to claim 1, wherein the annular portion (22, 222) of the hydraulics housing (12, 212) has a second collar (75) by which the second lateral section (26) of the hydraulics housing (12, 212) is held in a radial direction of the shaft (20).

15. Pump device according to claim 1, wherein a pocket (229) is formed in at least one of the two lateral sections (24, 26) within which pocket an axially outer end of the associated first projection (28) is accommodated.

* * * * *